US007581449B2

(12) United States Patent
Miller

(10) Patent No.: US 7,581,449 B2
(45) **Date of Patent: *Sep. 1, 2009**

(54) SYSTEM AND METHOD FOR POWER PUMP PERFORMANCE MONITORING AND ANALYSIS

(75) Inventor: J. Davis Miller, Frisco, TX (US)

(73) Assignee: WRDS, Inc., Frisco, TX (US)

( * ) Notice: Subject to any disclaimer, the term of this patent is extended or adjusted under 35 U.S.C. 154(b) by 34 days.

This patent is subject to a terminal disclaimer.

(21) Appl. No.: 11/914,361

(22) PCT Filed: May 15, 2006

(86) PCT No.: PCT/US2006/018679

§ 371 (c)(1),
(2), (4) Date: Nov. 13, 2007

(87) PCT Pub. No.: WO2006/124746

PCT Pub. Date: Nov. 23, 2006

(65) Prior Publication Data

US 2008/0196512 A1 Aug. 21, 2008

Related U.S. Application Data

(60) Provisional application No. 60/681,506, filed on May 16, 2005.

(51) Int. Cl.
*G01L 7/16* (2006.01)

(52) U.S. Cl. ..... 73/744; 701/182; 701/183

(58) Field of Classification Search ..... 417/437; 702/182, 177, 179, 183
See application file for complete search history.

(56) References Cited

U.S. PATENT DOCUMENTS

| | | | | |
|---|---|---|---|---|
| 6,206,108 | B1 * | 3/2001 | MacDonald et al. | 175/24 |
| 6,208,497 | B1 * | 3/2001 | Seale et al. | 361/160 |
| 6,582,204 | B2 * | 6/2003 | Gray, Jr. | 417/364 |
| 6,882,960 | B2 * | 4/2005 | Miller | 702/182 |
| 2004/0167738 | A1 * | 8/2004 | Miller | 702/114 |
| 2005/0180868 | A1 * | 8/2005 | Miller | 417/437 |

* cited by examiner

*Primary Examiner*—Andre J Allen
(74) *Attorney, Agent, or Firm*—Gardere Wynne Sewell LLP

(57) ABSTRACT

A power pump performance analysis system and methods includes a signal processor connected to certain sensors for sensing pressures and stresses in the cylinder chambers and the inlet and discharge piping of a single or multicylinder pump. Pump speed and pump piston position may be determined by a crankshaft position sensor. Performance analyses for pump work performed, pump cylinder chamber stress, pump fluid end useful cycles to failure, and crosshead loading and shock analysis are provided for estimating pump component life and determining times for component replacement before failure.

8 Claims, 5 Drawing Sheets

Effect of periodic large strain cycles on fatigue life of AISI-SAE 4340 steel hardened and tempered to a yield strength of 1100 MPa (160 ksi) (Ref 3).

SYSTEM AND METHOD FOR POWER PUMP PERFORMANCE MONITORING AND ANALYSIS

BACKGROUND OF THE INVENTION

Fluid Dynamic factors in reciprocating piston pump systems can cause several modes of mechanical failure of pump components. Failed components include fluid end modules, power end frames, cranks, connecting rods, bearings, gears, drive couplings and transmissions.

Pump component failures result from excessive mechanical cyclic stress from fluid dynamic factors or cavitation, or the combination of high tensile stress and corrosion. The effects of fluid corrosive properties are difficult to define but are important in the cyclic stress corrosion process. Inadequate pump maintenance leads to increased cyclic stress from changes in the pump fluid dynamics.

The general design of pump fluid-end modules with intersecting bores of the piston and valve chambers result in high stress concentrations that may result in the stress being as much as two to four times the normal hoop stress observed in pump cylinders. Generally the stress level must be past the material yield point to initiate and propagate a crack to ultimate failure such as the leaking of fluid from the pump fluid-end module.

Life cycle cost of pump components is generally evaluated either by pump operating cycles or hours of operation. In fixed speed and pressure applications such parameters are good approximations. However, using pump cycles or hours of operation will lead to inaccurate conclusions if pump speeds, system pressures or system dynamic factors, such as hydraulic resonance change during operation.

SUMMARY OF THE INVENTION

A significantly improved method to determine the life cycle cost of pump components is to evaluate pump components on work performed. A pump monitor system and method in accordance with the present invention provides for determining work performed for each pump revolution. Hydraulic work is defined by the flow rate multiplied by average differential pressure. On the other hand this method does not account for dynamic work. Dynamic work is defined hydraulic work with a factor applied that accounts for both the actual stress amplitude and number of addition stress cycles that occurs on each revolution of the pump.

In accordance with the present invention a summation of the dynamic work per revolution of the pump from installation to failure for any pump component provides an accurate method of determining life cycle costs.

U.S. Pat. No. 6,882,960, issued to J. Davis Miller on Apr. 19, 2005, which is incorporated herein by reference, provides an improved system for monitoring and analyzing performance parameters of reciprocating piston or so-called power pumps and associated piping systems. In addition to the improvements disclosed and claimed in the '960 patent and as described above, there has been a need to provide further monitoring and analysis of pump work performed for positive displacement reciprocating pumps, a method of determining pump chamber or cylinder stress cycles per revolution of the pump crankshaft, a method of determining pump cylinder chamber cycles to failure from cyclic stress fatigue, a method of determining individual cylinder crosshead guide loads, a method of determining individual cylinder upper crosshead guide shock loads and a method of determining crank position with respect to individual upper crosshead guide shock loads.

In accordance with the present invention, such additional monitoring and analysis methods have been developed.

DETAILED DESCRIPTION OF PREFERRED EMBODIMENTS

Figure 1:
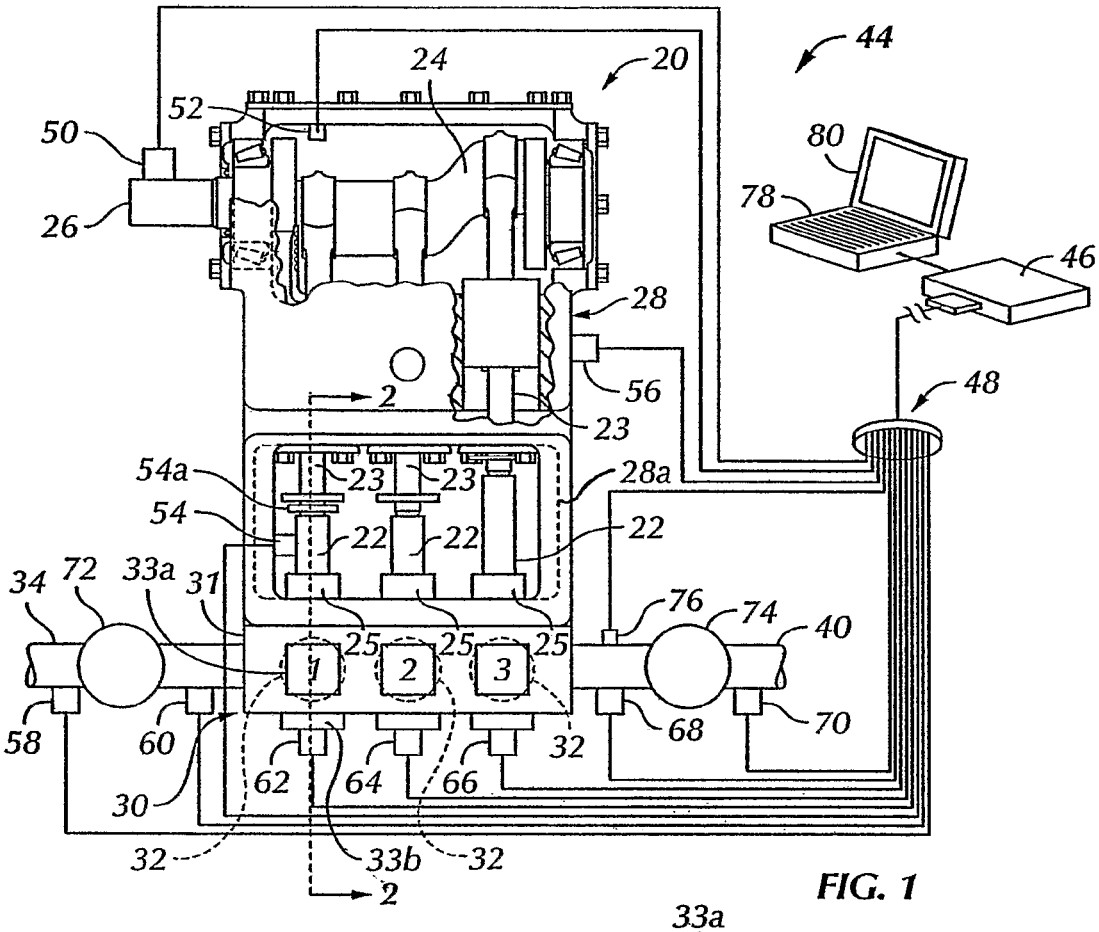
FIG. 1 is a top plan view in somewhat schematic form showing a reciprocating plunger or piston power pump connected to the performance analysis system of the present invention.

In the description which follows like elements are marked throughout the specification and drawing with the same reference numerals, respectively. Certain features may be shown in somewhat schematic form in the interest of clarity and conciseness.

Referring to FIG. 1, there is illustrated in somewhat schematic form, a reciprocating plunger or piston power pump, generally designated by the numeral 20. The pump 20 may be one of a type well-known and commercially available and is exemplary in that the pump shown is a so-called triplex plunger pump, that is the pump is configured to reciprocate three spaced apart plungers or pistons 22, which are connected by suitable connecting rod and crosshead mechanisms, as shown, to a rotatable crankshaft or eccentric 24. Crankshaft or eccentric 24 includes a rotatable input shaft portion 26 adapted to be operably connected to a suitable prime mover, not shown, such as an internal combustion engine or electric motor, for example. Crankshaft 24 is mounted in a suitable, so-called power end housing 28 which is connected to a fluid end structure 30 configured to have three separate pumping chambers exposed to their respective plungers or pistons 22, one chamber shown in FIG. 2, and designated by numeral 32.

Figure 2:
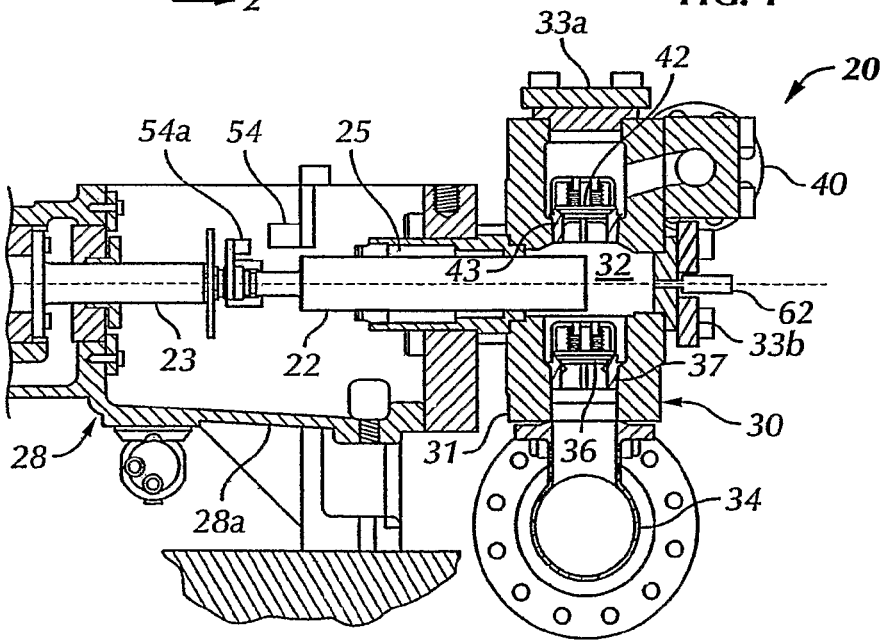
FIG. 2 is a longitudinal central section view taken generally along line 2-2 of FIG. 1.

FIG. 2 is a more scale-like drawing of the fluid end 30 which, again, is that of a typical multi-cylinder power pump and the drawing figure is taken through a typical one of plural pumping chambers 32, one being provided for each plunger or piston 22, the term piston being used hereinafter. FIG. 2 illustrates fluid end 30 comprising a housing 31 having the aforementioned plural cavities or chambers 32, one shown, for receiving fluid from an inlet manifold 34 by way of conventional poppet type inlet or suction valves 36, one shown. Piston 22 projects at one end into chamber 32 and is connected to a suitable crosshead mechanism, including a crosshead extension member 23. Crosshead member 23 is operably connected to the crankshaft or eccentric 24 in a known manner. Piston 22 also projects through a conventional packing or piston seal 25, FIG. 2. Each chamber for each of the pistons 22 is configured generally like the chamber 32 shown in FIG. 2 and is operably connected to a discharge piping manifold 40 by way of a suitable discharge valve 42, as shown by example. The valves 36 and 42 are of conventional design and are typically spring biased to their closed positions. Valve 36 and 42 each also include or are associated with removable valve seat members 37 and 43, respectively. Each of valves 36 and 42 may also have a seal member formed thereon engageable with the associated valve seat to provide fluid sealing when the valves are in their respective closed and seat engaging positions.

The fluid end 30 shown in FIG. 2 is exemplary, shows one of the three cylinder chambers 32 provided for the pump 20, each of the cylinder chambers for the pump 20 being substantially like the portion of the fluid end illustrated. Those skilled in the art will recognize that the present invention may be carried out in connection with a wide variety of single and multi-cylinder reciprocating piston power pumps as well as possibly other types of positive displacement pumps. However, the system and methods of the invention are particularly useful for analysis of reciprocating piston or plunger type pumps. Moreover, the number of cylinders of such pumps may vary substantially between a single cylinder and essentially any number of cylinders or separate pumping chambers and the illustration of a so called triplex or three cylinder pump is exemplary.

Referring further to FIG. 1, the so-called pump monitor system or performance analysis system of the invention is illustrated and generally designated by the numeral 44 and is characterized, in part, by a digital signal processor 46 which is operably connected to a plurality of sensors via suitable conductor means 48. The processor 46 may be of a type commercially available such as an Intel Pentium 4 capable of high speed data acquisition using Microsoft WINDOWS XP type operating software, and may include wireless remote and other control options associated therewith. The processor 46 is operable to receive signals from a power input sensor 50 which may comprise a torque meter or other type of power input sensor. Power end crankcase oil temperature may be measured by a sensor 52. Crankshaft and piston position may be measured by a non-intrusive sensor 54 including a beam interrupter 54*a*, FIG. 2, mountable on a pump crosshead extension 23, for example, for interrupting a light beam provided by a suitable light source or optical switch. Sensor 54 may be of a type commercially available such as a model EE-SX872 manufactured by Omron Corp. and may include a magnetic base for temporary mounting on part of power end frame member 28*a*. Beam interrupter 54*a* may comprise a flag mounted on a band clamp attachable to crosshead extension 23 or piston 22. Alternatively, other types of position sensors may be mounted so as to detect crankshaft or eccentric position.

Referring further to FIG. 1 a vibration sensor 56 may be mounted on power end 28 or on the discharge piping or manifold 40 for sensing vibrations generated by the pump 20. Suitable pressure sensors 58, 60, 62, 64, 66, 68 and 70 are adapted to sense pressures as follows. Pressure sensors 58 and 60 sense pressure in inlet piping and manifold 34 upstream and downstream of a pressure pulsation dampener or stabilizer 72, if such is used in a pump being analyzed. Pressure sensors 62, 64 and 66 sense pressures in the pumping chambers of the respective plungers or pistons 22 as shown by way of example in FIG. 2 for chamber 32 associated with pressure sensor 62. Pressure sensors 68 and 70 sense pressures upstream and downstream of a discharge pulsation dampener 74. Still further, a fluid temperature sensor 76 may be mounted on discharge manifold or piping 40 to sense the discharge temperature of the working fluid. Fluid temperature may also be sensed at the inlet or suction manifold 34.

Pump performance analysis using the system 44 may require all or part of the sensors described above, as those skilled in the art will appreciate from the description which follows. Processor 46 may be connected to a terminal or further processor 78, FIG. 1, including a display unit or monitor 80. Still further, processor 46 may be connected to a signal transmitting network, such as the Internet, or a local network.

Figure 3:
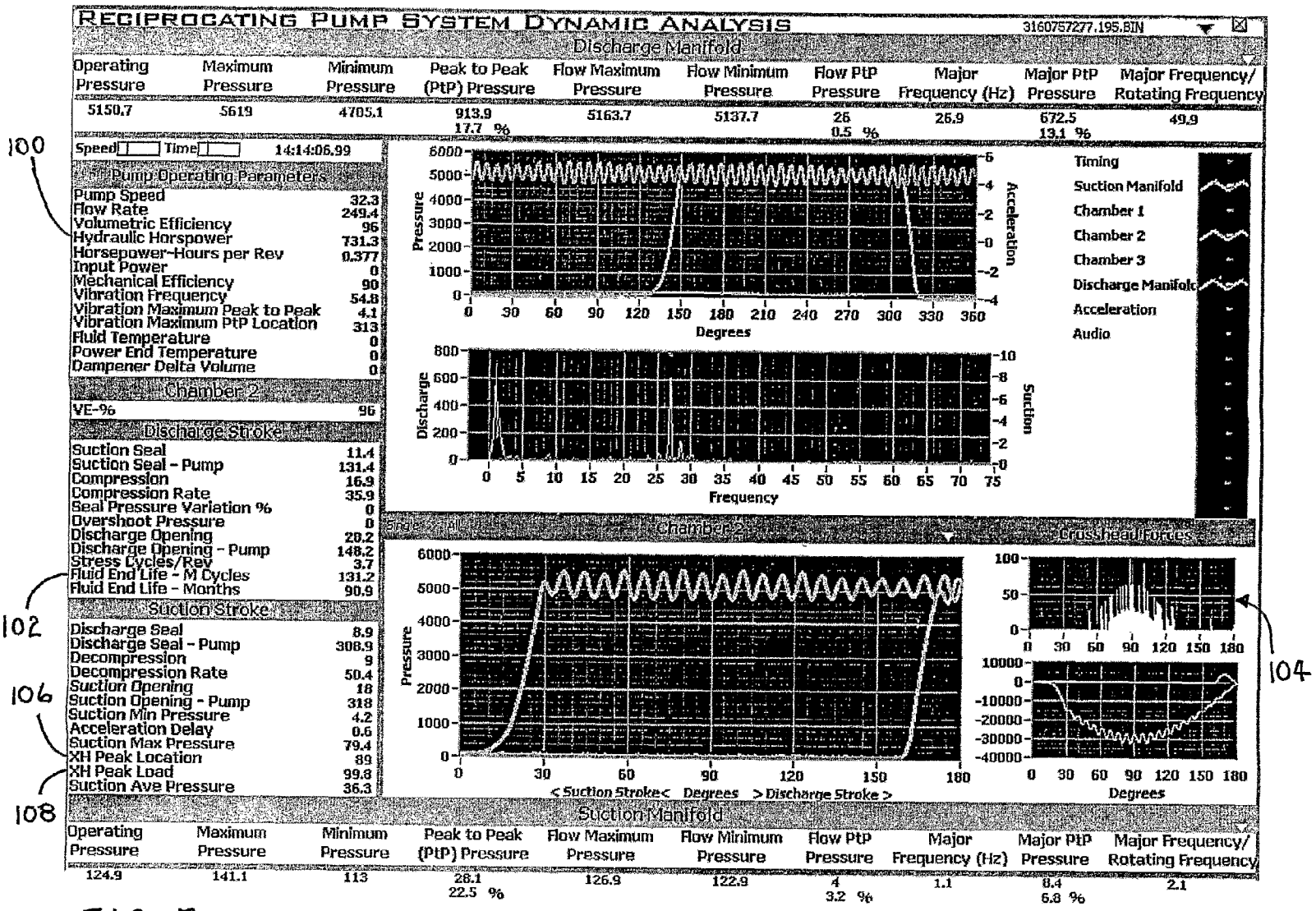
FIG. 3 is a so-called screen shot of a display illustrating the results of the methods in accordance with the invention.

System 44 is adapted to provide a wide array of graphic displays and data associated with the performance of a power pump, such as the pump 20 on a real time or replay basis, as shown in FIG. 3, by way of example.

The following comprises descriptions of improved methods of determining pump work performed, pump chamber cycle stress, pump fluid end useful cycles to failure and pump crosshead loading and shock analysis.

The life cycle cost of pump components is generally evaluated on either pump cycles or hours of operation. While in a fixed speed and pressure application, pump cycles or hours of operation can be used as a good approximation of component life, such will lead to inaccurate conclusions if speeds, pressures or system dynamics change during operation. A significantly improved method to determine the life cycle cost of pump components is to evaluate pump components on work performed. The pump monitor system 44 of the invention calculates horsepower-hours or kilowatt-hours for each pump revolution. A summation of the individual horsepower-hours or kilowatt-hours from installation to failure will provide an accurate method of determining life cycle cost for any pump component in a stable dynamic environment.

The pump monitor system 44 provides a method to calculate work performed by the pump to date or to failure of a pump component. Pump work is calculated from a previously calculated hydraulic power being delivered by the pump during one revolution of the pump. Pump work performed in horsepower-hour or kilowatt-hour for one revolution of the pump is calculated as follows:

A method of determining pump hydraulic power ($P_{kw}$) per revolution is as follows:

$$P_{kW}=k(P_{D\text{-}Ave}-P_{S\text{-}Ave})F_{m3/hr}$$

Where k=Kilo Watt conversion factor ($2.77824\times10^{-7}$)

$P_{D\text{-}Ave}$=Average discharge pressure—Pa $P_{S\text{-}Ave}$=Average suction pressure—Pa $F_{m3/hr}$=Pump average flow rate A value may be shown at 100 in FIG. 3.

A method of determining pump hydraulic work ($W_{Hyd}$) performed per revolution is as follows:

$$W_{Hyd-Rev}=\frac{P_{kW}}{S_{rpm}60}$$

A value may be shown at 100 in FIG. 3.

A method of determining chamber dynamic work performed per pump revolution is as follows:

$$W_{Dyn-Rev}(c)=S_{f(c)}\frac{P_{C-Max}}{P_{D-Ave}}W_{Hyd-Rev}$$

Where $S_{f(c)}$=Cylinder stress cycle factor $P_{C\text{-}Max}$=Chamber maximum pressure $P_{D\text{-}Ave}$=Discharge average pressure A value may be shown at 100 in FIG. 3.

Cumulative Work Performed and Shock Loading during an operating period can be determined. A summation of the individual kilowatt-hours from installation to failure will provide an accurate method of determining life cycle cost for any pump component in a stable dynamic environment. Cumulative work performed can be used to predict component life when data is collected for the complete operating period of a pump component from installation to failure.

A method of calculating pump total hydraulic work is as follows:

Total hydraulic work for any component is calculated from the sum of kilowatt-hour per revolution from individual pump chamber cycles for that component.

$$W_{Hyd} = \sum_{n} W_{Hyd-Rev}(i)$$

A method of calculating pump total chamber dynamic work is as follows:

Total cylinder dynamic work for any component is calculated from the sum of kilowatt-hour per revolution from individual pump chamber cycles for that component.

$$W_{Dyn(c)} = \sum_{n} W_{Dyn-Rev(c)}(i)$$

A method of calculating pump average cylinder mechanical shock is as follows:

$$F_{XH-Ave}(c) = \frac{\sum_{n} F_{XH-Max(c)}(i)}{n}$$

A combination of high tensile stress and corrosion is the major cause of reciprocating pump fluid-end module and other component failures. Fluid corrosive properties are difficult to define but are extremely important in the cyclic stress corrosion process. The general design of pump fluid-end modules with intersecting bores of a piston and valve chamber results in stress concentrations at the intersection. A stress of two to four times the normal hoop stress in pump cylindrical chambers occurs at the intersection of the bores. Generally the stress level must be past the material yield point to initiate a crack that then propagates to ultimate failure (leaking of fluid from the fluid-end module) from normal stress cycles.

As mentioned hereinabove, life cycle cost of pump components is generally evaluated on either pump cycles or hours of operation. In unstable systems where system dynamics change or operation of inadequately maintained equipment occurs, the cyclic stress history must also be factored into the life cycle cost.

Cyclic Stress applied to positive displacement pump components is a function of the chamber peak pressure (not the discharge average pressure). System fluid dynamics during the discharge stroke will result in additional stress cycles being applied in addition to the single pump cycle. Therefore, the pump will experience from 1+ to 5 times or more stress cycles for each revolution of the pump. A method is presented to determine the total stress cycles per revolution of the pump.

A method of calculating chamber cumulative stress cycle factor per revolution of pump can be determined. Fluid dynamic peak-to-peak hydraulic pressure variation occurring during the pump discharge stroke results in additional cyclic stress that decreases the number of pump revolutions to failure. Each additional pressure cycle during the discharge stroke adds a proportional stress component. A pump stress factor is calculated to indicate the number of equivalent stress cycles the pump fluid-end module and mechanical components are experiencing during one revolution of the pump.

$$S_f = 1 + \sum_{1}^{n} \frac{\Delta P_i}{P_{peak}}$$

Where:

n=Number of incremental pressure cycles during discharge stroke $\Delta P_i$=Incremental differential pressure cycle during discharge stroke $P_{peak}$=Peak chamber pressure during discharge stroke A value may be shown at 102 in FIG. 3.

A method of calculating fluid-end module life from cyclic stress fatigue can be determined. A pump fluid-end module has a minimum of one stress cycle per revolution of the pump at the following stress level. Estimated million pump cycles to fluid-end failure is reduced by the additional stress cycles that occur during the pump discharge cycle. A value is computed for each pump chamber for each revolution of the pump Calculate pump chamber stress $$S_{mPa} = k\frac{P_m D}{2t}10^{-6} \approx k\frac{P_{max}D10^{-6}}{50.8}$$

Figure 5:
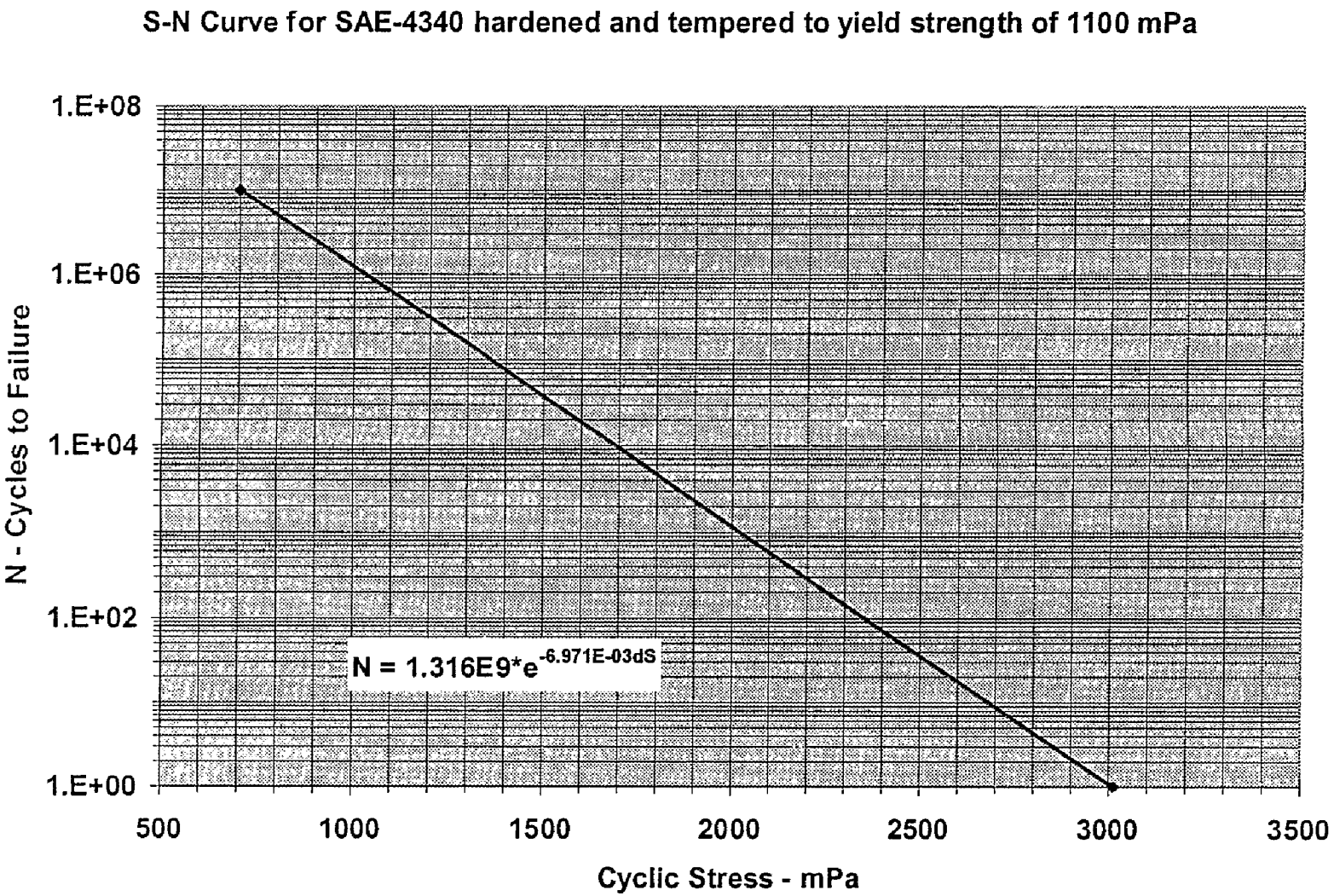
FIG. 5 is a diagram of cyclic stress versus cycles to failure (S-N) for an alloy steel.

Where:

k=Stress Concentration factor for intersecting bore t=Assumed minimum wall thickness—25.4 mm $P_{max}$=Maximum Chamber Pressure—Pa D=Piston Diameter—mm A method of calculating pump cycles to failure from cyclic stress can be determined. A pump fluid-end module will fail from cyclic stress corrosion cracking after a given number of stress cycles based on an S-N curve for the fluid being pumped and the material used in the manufacture of the pump fluid-end. The S-N curve of FIG. 5 is representative of the concept and an actual curve will be developed from laboratory testing or field experience. The data is often fit to a simple power function relating stress amplitude to fatigue life.

$N=me^{b\Delta S}$ Pump cycles to failure for ΔS greater than lower fatigue limit m=1.316E9 Sample fatigue limit coefficient b=−0.006971 Sample fatigue limit exponent ΔS=Chamber differential stress cycle Calculate pump Fluid-End Module life in years $$L_y = \frac{N10^{-6}}{S_f S_{rpm} 1.903}$$

Where $S_{rpm}$=Pump Speed in revolutions per minute

Figure 4:
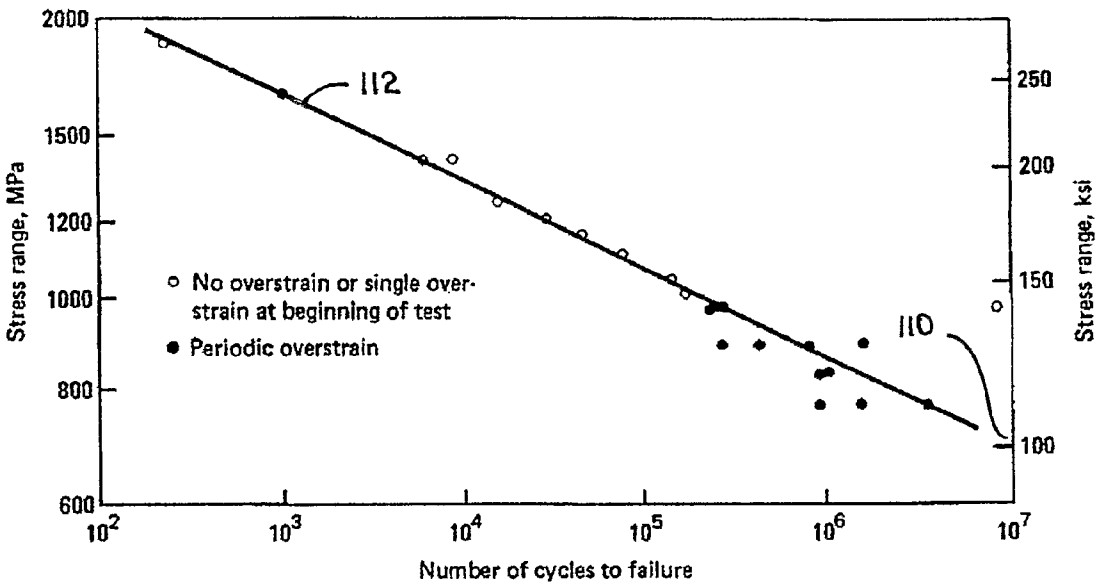
FIG. 4 is a diagram illustrating the effect of periodic large strain cycles on fatigue life of alloy steel hardened and tempered to a particular yield strength.

Pump fluid-end useful cycles to failure may also be calculated based on the following assumptions:

a. A pump fluid-end will fail from cyclic stress corrosion cracking after a given number of stress cycles based on an S-N curve for the fluid being pumped and the material used in the pump fluid-end. The S-N curve is only representative of the concept and an actual curve will have to be developed from laboratory testing or field experience.
   1. The S-N curve in FIG. 5 is an example and the basis for calculating the N (cycles to failure) for conditions existing during one pump cycle.
   2. $N=10^{7}{}_{@100ksi}$ see FIG. 4 at 110
   3. $N=10^{3}{}_{@240ksi}$ see FIG. 4 112
   4. $N=10^{27}S_{ksi}^{-10.5}$ Equation for N cycles to failure b. A pump fluid-end chamber has a minimum of one stress cycle per revolution of the pump at the following stress level. The amplitude of the stress is based on the peak chamber pressure and not the average discharge pressure.

$$S_{ksi} = k\frac{P_m D}{2t}10^{-6} \approx P_m D 10^{-6}$$

Stress for one pump revolution—ksi or mPa

Where:

k=2 Assumed Stress Concentration factor for intersecting bore t=1 Assumed minimum wall thickness—in or mm $P_m$=Maximum Chamber Pressure—psi or kPa D=Piston Diameter—in or mm c. Number of cycles to failure based on single pump cycle stress.

$N=10^{27}S_{ksi}^{-10.5}$ Cycles to failure d. Fluid dynamic peak-to-peak hydraulic pressure variation occurring during the pump discharge stroke results in additional cyclic stress that decreases the number of pump revolutions to failure. Each additional pressure cycle during the discharge stroke adds a proportional stress component. A pump stress factor is calculated to indicate the number of equivalent stress cycles the pump fluid-end is experiencing during one revolution of the pump.

$$S_f = 1 + \sum_{1}^{n}\frac{\Delta P_i}{P} \quad 2)$$

$S_f$=Stress Factor

P =Pressure n=number of addition pressure cycles during discharge stroke e. Estimated million pump cycles to fluid-end failure is reduced by the additional stress cycles that occur during the pump discharge cycle. A value is computed for each pump chamber for each revolution of the pump.

$$N_m = \frac{N}{S_f}10^{-6} \quad 3)$$

f. Estimated fluid-end life in months is calculated for each pump chamber for each revolution of the pump based on the pump speed during that revolution.

$$L_m \frac{N_m 10^6}{S_{rpm} 43200}$$

g. Estimated pump fluid-end life used factor is calculated from the sum of data collected from individual pump cycles.

$$L_u = \frac{10^6 N_a^2}{\sum_N N_m}$$

$N_a$=Actual pump cycle count

Reciprocating pump power-end and power drive components will fail from cyclic stress if excessive dynamics loads are placed of the mechanical system. Dynamic mechanical loads are either hydraulic loading during the discharge stroke where hydraulic forces are transferred directly through the entire mechanical drive system or mechanical shocks induced during the suction stroke. Mechanical shocks occur in the power-end during the suction stroke when the pressurizing component (piston or plunger) changes from tensile to compressive loading. When the change from tensile to compressive loading occurs, all the mechanical tolerances in the crosshead and guide system, wrist pin bearing, connecting rod bearing, crank bearing, and gearing are transferred to opposite load bearing surfaces. The shock force with which this occurs is a function of hydraulic pressure dynamics during the suction stroke. Crosshead loading and shock forces are a function of hydraulic forces and pump crank angle during the discharge stroke when the connecting rod is above the centerline.

Crosshead load in the vertical direction is a function of the crank angle and the piston rod load plus the weight of the crosshead components.

Given:

D—Diameter of Piston or Plunger d—Diameter of extension Rod

S—Pump Stroke

L—Connecting Rod Length

W—Weight of Crosshead Components

θ—Crank Angle $P_{HE}$—Pressure on Head End (θ)

$P_{CE}$—Pressure on Crank End (θ)

Calculate:

$$\alpha = \arcsin\left(\frac{S\sin(\theta)}{2L}\right)$$

$$F_{HE} = 0.7854\,D^2 P_{HE}(\theta)$$

$$F_{HE} = 0.7854\,(D^2 - d^2)P_{CE}(\theta)$$

$$FW = W$$

$$F_C = \frac{F_{HE} - F_{CE}}{\cos(\alpha)}$$

$$F_{XH} = F_C\sin(\alpha) - F_W$$

During the discharge stroke when the connecting rod is above the centerline of the plunger a downward force is applied to the bottom crosshead. During the suction stroke a crosshead lifting force is applied to the crosshead assembly based on chamber fluid pressures and the pump crank angle at any given point in time. When the lifting force exceeds the mass of the crosshead assembly there will be a resultant force applied to the upper crosshead guide.

Figure 6:
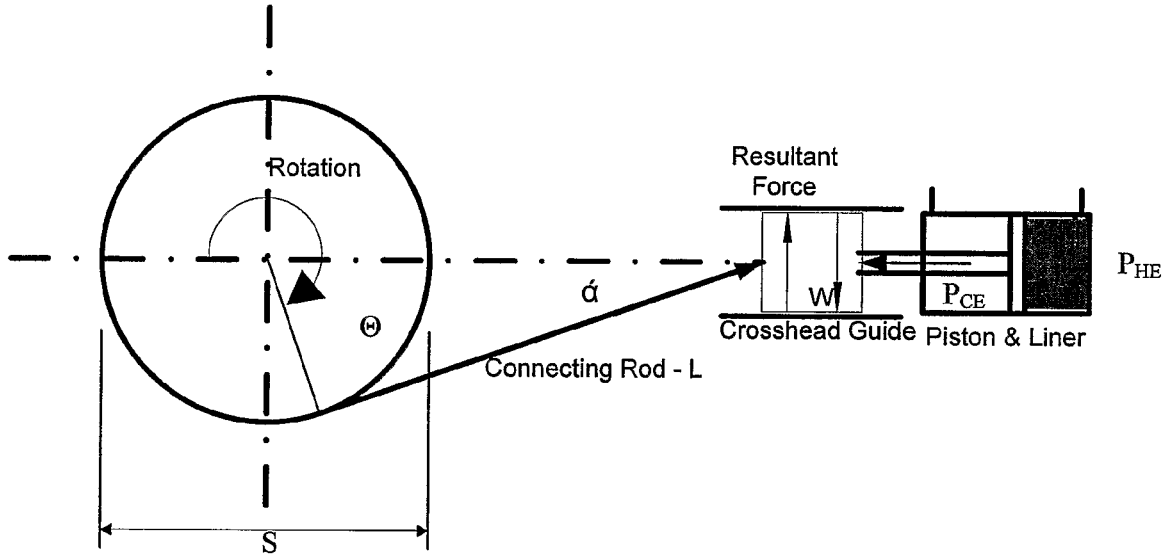
FIG. 6 is a schematic diagram illustrating certain relationships between a pump crankshaft, connecting rod, crosshead guide and piston and liner.

Referring to FIG. 6, and:

Given

D=Diameter of Piston or Plunger d=Diameter of Extension Rod

S=Pump Stroke

L=Connecting Rod Length

M=Mass of Crosshead Components

Θ=Crank Angle $P_{HE(\Theta)}$=Pressure on Head End $P_{CE(\Theta)}$=Pressure on Crank End—Double Acting Pump Calculate:

$$\alpha = \arcsin\left(\frac{S\sin(\Theta)}{2L}\right)$$

$$F_{HE(\Theta)} = 0.7854\,D^2 P_{HE(\Theta)}$$

$$F_{CE(\Theta)} = 0.7854\,(D^2 - d^2)P_{CE(\Theta)}$$

$$F_W = M$$

$$F_{XH(\Theta)} = (F_{HE(\Theta)} - F_{CE(\Theta)})\tan(\alpha) - F_W$$

Crosshead lift occurs when $F_{XH(\Theta)}$ (the crosshead guide load) is greater than zero.

Crosshead guide shock occurs during the suction stroke when the resultant crosshead load changes from negative to positive lifting the crosshead from the bottom to top crosshead guide. There is normal lifting with minimal shock at the beginning of the suction stroke as the discharge pressure is still applied to the plunger and the connecting rod connection to the crank is below the centerline of the pump. Rapid lifting with high shock load occurs when chamber pressure increases from below suction pressure before the suction valve opens to a high surge pressure from the higher velocity suction fluid stream catches up to the plunger after the suction valve opens. Magnitude of surge pressure is based on the difference in higher suction fluid stream velocity and plunger velocity. The relative shock load is the differential lifting force at that point in time where the lifting load changes from negative to positive.

A Method of calculating individual cylinder upper crosshead guide shock load is as follows:

$$(F_{XH(\Theta)}>0) \text{ and } (F_{XH(\Theta-\Delta\Theta)}<0) \text{ then } (\Delta F_{XH(\Theta)}=F_{XH(\Theta)})$$

See FIG. 3 at 104.

A Method of calculating individual cylinder crank rotational position of upper crosshead guide maximum shock load during pump cycle is as follows:

$$\max(\Delta F_{XH(\Theta)}) \text{ then } \Theta_{Fmax}=\Theta$$

See FIG. 3 at 106.

A Method of calculating individual cylinder upper crosshead guide maximum shock load during the pump cycle is as follows:

$$F_{XH}(c)=\Delta F_{XH(\Theta Fmax)}$$

See FIG. 3 at 108.

Although preferred methods in accordance with the invention have been described in detail herein, those skilled in the art will recognize that various substitutions and modifications may be made without departing from the scope and spirit of the appended claims.

What is claimed is:

1. A method for determining selected performance parameters of a reciprocating piston power pump, said pump comprising components including a housing providing at least one fluid chamber therein, a fluid inlet valve opening into said chamber, a fluid discharge valve for discharging fluid from said chamber, a rotatable crankshaft or eccentric, a reciprocating piston operably connected to said crankshaft and operable to displace fluid from said chamber, at least one pressure sensor in communication with said chamber for measuring pressure therein, at least one position sensor for sensing the position of said piston with respect to said chamber, and a signal processor operably connected to said sensors for receiving signals from said sensors, respectively, said method including:

determining at least one performance parameter selected from a group consisting of pump hydraulic power per revolution of said crankshaft, pump hydraulic work performed per revolution of said crankshaft, chamber dynamic work performed per revolution of said crankshaft, total pump hydraulic work per revolution of said crankshaft, total chamber dynamic work per revolution of said crankshaft, average mechanical shock imposed on said housing, a cumulative stress cycle factor per revolution of said crankshaft, stress imposed on said housing for each chamber per revolution of said crankshaft, pump operating cycles in revolutions of said crankshaft to failure of at least one of said housing, said piston and said crankshaft, a stress factor to determine the number of equivalent stress cycles imposed on said housing per revolution of said crankshaft, housing life in months for each chamber per revolution of said crankshaft, crosshead load in a vertical direction, crosshead guide shock load and upper crosshead guide maximum shock load per revolution of said crankshaft; and replacing one or more pump components prior to failure based on determining said at least one of said parameters.

2. The method set forth in claim 1 wherein:

said pump hydraulic power per revolution is determined by comparing average fluid discharge pressure, average fluid inlet pressure and average fluid flow rate with respect to said chamber.

3. The method set forth in claim 1 wherein:

said pump hydraulic work performed per revolution of said crankshaft is determined by dividing pump speed in revolutions per minute into pump hydraulic power per revolution.

4. The method set forth in claim 1 wherein:

said chamber dynamic work is determined by comparing a stress cycle factor with chamber maximum pressure divided by average fluid discharge pressure from said chamber multiplied by hydraulic work performed per revolution.

5. The method set forth in claim 1 wherein:

said average mechanical shock is determined by the summation of forces exerted on a crosshead guide provided in said housing.

6. The method set forth in claim 1 wherein:

the step of determining chamber cumulative stress cycle factor is carried out by summing the incremental pressure cycles compared with an incremental pressure differential during a fluid discharge stroke of said pump divided by the peak chamber pressure during said discharge stroke.

7. The method set forth in claim 1 wherein:

the step of determining the stress imposed on said housing for each chamber is carried out by comparing a stress concentration factor for intersecting bores of said chamber with an assumed minimum wall thickness of said chamber with a maximum chamber pressure and with the diameter of said piston.

8. The method set forth in claim 1 wherein:

the step of determining the number of pump operating cycles to failure from cyclic stress is determined by comparing a sample fatigue limit coefficient with a sample fatigue limit exponent with chamber differential stress cycle with pump cycles to failure for a chamber differential stress cycle greater than the lower fatigue limit of the material from which said housing is constructed.

* * * * *